United States Patent [19]

Shneider

[11] 3,959,903

[45] June 1, 1976

[54] PROTECTORS FOR ROTARY DISPLAY STANDS

[76] Inventor: Aaron H. Shneider, 2835 N. Western Ave., Chicago, Ill. 60618

[22] Filed: Feb. 28, 1975

[21] Appl. No.: 553,925

[52] U.S. Cl. ..... 40/68.6

[51] Int. Cl.[2] ..... G09F 11/02

[58] Field of Search ..... 40/68.6, 68, 72, 102, 40/124, 124.4; 312/186, 187; 211/169, 170

[56] References Cited

UNITED STATES PATENTS

| | | | |
|---|---|---|---|
| 2,083,703 | 6/1937 | Grumbacher | 40/72 |
| 2,703,744 | 3/1955 | Karper | 40/68.6 |

FOREIGN PATENTS OR APPLICATIONS

| | | | |
|---|---|---|---|
| 824,210 | 11/1959 | United Kingdom | 40/68.6 |

*Primary Examiner*—Louis G. Mancene
*Assistant Examiner*—John H. Wolff
*Attorney, Agent, or Firm*—S. J. Lehrer; William F. Frank

[57] ABSTRACT

A display stand containing a horizontally-rotatable group of pockets carried by a vertical spindle, the pockets open at the top. A plastic sheet covers the pockets to keep out falling dust, and is perforated for the passage of the spindle. When the stand is tilted to position the spindle horizontally, the sheet assumes the position of a side closure for the pockets, preventing their contents from moving out of the pockets.

1 Claim, 4 Drawing Figures

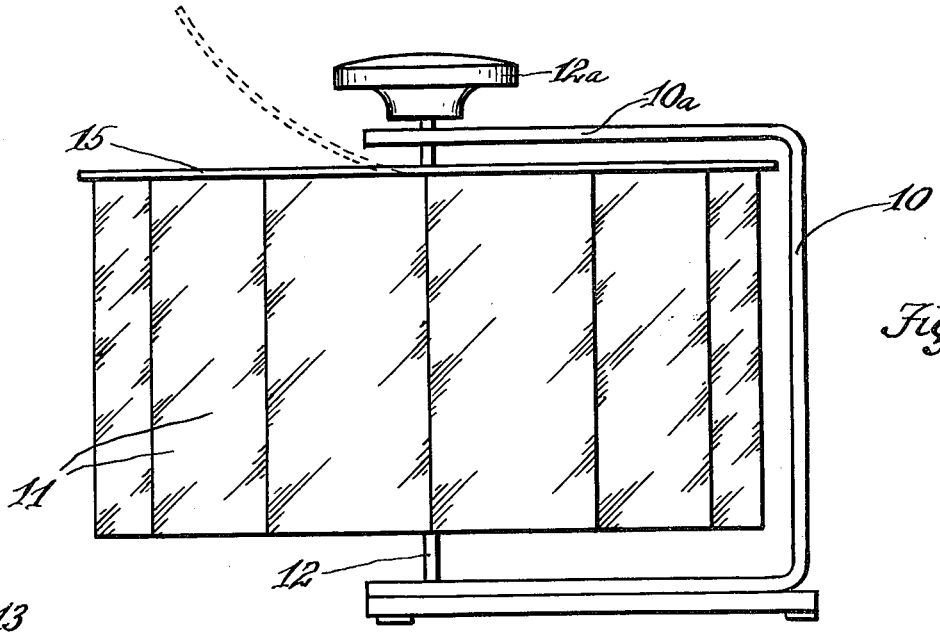
Fig. 1.
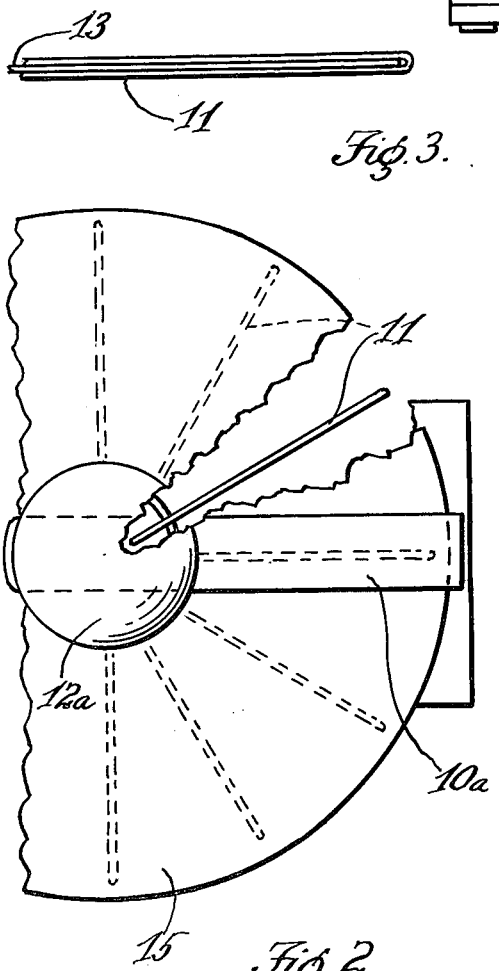
Fig. 3.
Fig. 2.
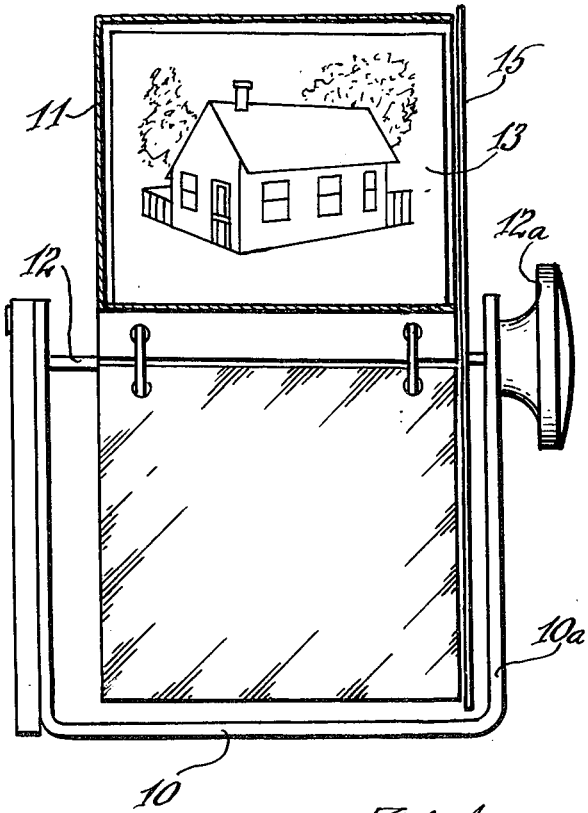
Fig. 4.

PROTECTORS FOR ROTARY DISPLAY STANDS

This invention relates to stands which carry a rotary group of transparent pockets in which picture cards are kept for display purposes. The stand incorporating the present invention serves in either of two positions. Thus, in one position it is known as the carousel type in which the pockets are carried around a vertical spindle; and the latter has a knob at the top for turning the display toward one side or the other. In another position the stand is known as the roto type in which the spindle is horizontal with the knob at one side, whereby to move the display up or down when viewed. Ordinarily the keeping or use of a carousel type stand exposes it to dust which falls into the cluster of pockets — which are open at the top — and makes it disagreeable to remove picture cards from the same. Also, the cleaning of pockets — usually one by one — is a messy operation. Further, where the stand is of the roto type, the problem of dust falling into the pockets is avoided, but because they open at one side, agitating or tilting the stand toward the side where the pockets open will cause some of the picture cards in the pockets to slide out in part or even entirely, so that special care must be used in the handling of the stand.

In view of the above conditions, it is one object of the present invention to provide a cover for the pockets when the stand is in the carousel type position and the pockets open upwardly, which is primarily a dust shield, but is also flexible upwardly to permit the insertion or removal of picture cards, and transparent to pass light into the group of pockets.

A further object is to provide an insert for the stand which serves as a closure when the stand is in the roto type position to keep the picture cards from sliding out of the pockets.

Another object is to provide the dual facility mentioned in a single piece, and without the need of adjustment or other attention when the stand is changed from one type to the other.

A better understanding of the invention may be gained by reference to the accompanying drawing, in which FIG. 1 is a side elevation of a carousel type display stand illustrating the invention as a cover;

FIG. 2 is a plan view of the showing in FIG. 1, partly broken away;

FIG. 3 is a magnified view of a portion of the pocket exposed in FIG. 2; and FIG. 4 is a front view of the stand in the roto type position, and shows the invention as a guard or closure for the pockets, the upper pocket shown in section to reveal a picture card therein.

Referring specifically to the drawing, FIG. 1 shows the C-shaped frame 10 of the stand positioned to receive a circular group of picture card pockets 11 from the left side; and the arms 10*a* of the stand journal a spindle 12 which carries the pocket group and rotates the same laterally when a finger knob 12*a* at the top of the spindle is turned. FIG. 2 shows one of the pockets 11 exposed; and FIG. 3 shows that it is open at the top and contains a picture card 13.

With the pockets viewed as in FIG. 2, it is obvious that they and their contents are exposed to falling dust. However, the present invention prevents this by providing a horizontal cover 15 for all the pockets. The cover is a circular sheet of hard but flexible plastic material, which is also transparent. The cover is an insert between the upper arm of the stand and the group of pockets 11 — as seen in FIG. 1 — and is perforated in the center for the passage of the spindle 12. The cover is inserted by springing the upper arm of the frame 10 from the upper end of the spindle before the knob is fitted. The cover is now a closure for the pockets, but allows light to pass into the zone of the same. The cover therefore serves to fully confine the picture cards against contamination by falling dust. Yet, the cover may be flexed as indicated by finely-dotted lines in FIG. 1 to permit the insertion or removal of picture cards.

To convert the stand from the carousel type to the roto type, it is only necessary to tilt it a quarter-turn to the right from the position of FIG. 1 to that of FIG. 4. This movement turns the cover 15 to the vertical position shown in the latter figure, where it becomes a side guard or closure for the open ends of the pockets 11, checking the picture cards therein from any sliding movement in outward direction. However, in case picture cards have to be inserted or removed, the cover 15 may be flexed as mentioned before to gain the necessary clearance.

It is now apparent that the invention is designed to serve two purposes according to the positions of the display stand. Yet, it occupies a fixed position in relation to the stand, and has the form of an insert which needs no added securing means, but is locked in place when the stand is completed. Finally, the invention is in a single piece, and needs no attention to position it either as a dust cover or a side guard, in keeping with the position of the stand.

I claim:

1. In a stand for displaying a plurality of record cards or photographs inserted into flat, rectangular card-receiving pockets having at least one transparent surface, which pockets are mounted on a spindle rotatable in said stand, each of said pockets having one open side for said insertions, said open sides being perpendicular to said spindle, the improvement comprising a flat, circular cover for said open sides of said pockets, means for positioning said cover onto said spindle and maintaining it adjacent said open sides, said cover being of a transparent plastic material having flexibility to permit deflecting a portion thereof away from said open sides so that one or more cards or photographs may be inserted or removed, whereby said cover in cooperation with said open sides results in substantially enclosed pockets.

* * * * *